US006769936B2

(12) United States Patent
Gutierrez et al.

(10) Patent No.: US 6,769,936 B2
(45) Date of Patent: Aug. 3, 2004

(54) CONNECTOR WITH INSERT ASSEMBLY AND METHOD OF MANUFACTURING

(75) Inventors: Aurelio J. Gutierrez, Bonita, CA (US); Tsou Zheng Rong, Jungli (TW)

(73) Assignees: Pulse Engineering, San Diego, CA (US); Full Rise Electronics Co., Ltd. (TW)

( * ) Notice: Subject to any disclaimer, the term of this patent is extended or adjusted under 35 U.S.C. 154(b) by 0 days.

(21) Appl. No.: 10/139,907

(22) Filed: May 6, 2002

(65) Prior Publication Data

US 2003/0207621 A1 Nov. 6, 2003

(51) Int. Cl.[7] ..... H01R 24/00
(52) U.S. Cl. ..... 439/676; 439/76.1
(58) Field of Search ..... 439/76.1, 620, 439/676

(56) References Cited

U.S. PATENT DOCUMENTS

| | | | | |
|---|---|---|---|---|
| 5,015,981 A | | 5/1991 | Lint et al. | |
| 5,069,641 A | | 12/1991 | Sakamoto et al. | |
| 5,587,884 A | | 12/1996 | Raman | |
| 5,613,873 A | | 3/1997 | Bell, Jr. | |
| 5,647,767 A | | 7/1997 | Scheer et al. | |
| 5,736,910 A | | 4/1998 | Townsend et al. | |
| 5,876,239 A | | 3/1999 | Morin et al. | |
| 5,885,100 A | | 3/1999 | Talend et al. | |
| 6,010,367 A | * | 1/2000 | Wu | 439/620 |
| 6,080,011 A | | 6/2000 | Tsao et al. | |
| 6,116,963 A | | 9/2000 | Shutter | |
| 6,227,911 B1 | * | 5/2001 | Boutros et al. | 439/620 |
| 6,346,010 B1 | | 2/2002 | Emplit | |
| 6,350,158 B1 | | 2/2002 | Arnett et al. | |
| 6,409,547 B1 | | 6/2002 | Reede | |
| 6,409,548 B1 | | 6/2002 | Guttierez | |
| 6,413,120 B1 | | 7/2002 | Winings et al. | |
| 6,413,121 B1 | | 7/2002 | Hyland | |
| 6,419,526 B1 | | 7/2002 | Fair et al. | |
| 6,428,361 B1 | * | 8/2002 | Imschweiler et al. | 439/676 |
| 6,431,906 B1 | | 8/2002 | Belopolsky | |
| 6,447,341 B1 | | 9/2002 | Hyland | |
| 6,454,595 B1 | | 9/2002 | Espenshade | |
| 6,457,993 B1 | | 10/2002 | Espenshade | |
| 6,554,638 B1 | * | 4/2003 | Hess et al. | 439/490 |

* cited by examiner

*Primary Examiner*—Khiem Nguyen
(74) *Attorney, Agent, or Firm*—Gazdzinski & Associates

(57) ABSTRACT

An advanced modular plug connector assembly incorporating a substantially planar, low profile removable insert assembly with associated substrate disposed in the rear portion of the connector housing, the substrate adapted to optionally receive one or more electronic components. In one embodiment, the connector assembly comprises a single port with a single insert assembly. The conductors and terminals of the connector are retained within respective molded carriers which are received within the insert assembly. A plurality of light sources (e.g., LEDs) are also received within the housing, the conductors of the LEDs mated with conductive traces on the substrate of the insert assembly. In another embodiment, the connector assembly comprises a multi-port "1×N" device. Methods for manufacturing the aforementioned embodiments are also disclosed.

38 Claims, 13 Drawing Sheets

(PART I OF IV)

(PART II OF IV)

(PART III OF IV)

(PART IV OF IV)

CONNECTOR WITH INSERT ASSEMBLY AND METHOD OF MANUFACTURING

BACKGROUND OF THE INVENTION

1. Field of the Invention

The present invention relates generally to electronic components and particularly to an improved design and method of manufacturing a single- or multi-connector assembly which may include internal electronic components.

2. Description of Related Technology

Modular connectors, such as for example those of the "RJ" configuration, are well known in the electronics industry. Such connectors are adapted to receive one or more modular plugs of varying type (e.g., RJ-45 or RJ-11), and communicate signals between the terminals of the modular plug and the parent device with which the connector is associated. Commonly, some form of signal conditioning (e.g., filtering, voltage transformation, or the like) is performed by the connector on the signals passing through it.

Many different considerations are involved with producing an effective and economically viable connector design. Such considerations include, for example: (i) volume and "footprint" available for the connector; (ii) the need for electrical status indicators (e.g., LEDs); (iii) the cost and complexity associated with assembling and manufacturing the device; (iv) the ability to accommodate various electrical components and signal conditioning configurations; (v) the electrical and noise performance of the device; (vi) the reliability of the device; (vii) the ability to modify the design to accommodate complementary technologies; (viii) compatibility with existing terminal and "pin out" standards and applications; (ix) ability to configure the connector as one of a plurality of ports, potentially having individually variant internal component configurations, and (ix) potentially the maintenance or replacement of defective components.

Myriad different configurations for modular connectors have been heretofore disclosed in the prior art. However, these prior art configurations are not optimized in terms of the foregoing considerations. For example, many connector designs, while providing a low manufacturing cost, do not possess the necessary electrical or radiated noise performance required by particular applications. Designs which do meet these performance and noise requirements are often complex, require numerous manufacturing steps, and/or difficult to assembly, thereby raising cost and potentially detracting from reliability. Alternatively, the plurality of electrical signal conditioning components required to meet performance standards cannot be readily contained within the required connector volume/footprint without increasing noise/cross-talk, or significantly altering the connector terminal array configuration.

Accordingly, it would be most desirable to provide an improved electrical connector design that would yield a simple and reliable connector with superior electrical and noise performance, and further facilitate economical fabrication. Such a connector design would ideally allow for the use of anything ranging from none to a variety of different electronic signal conditioning components in the connector signal path(s), as well as status indicators if desired, without affecting connector profile or footprint, or requiring changes to the housing. The improved connector design would also facilitate easy assembly, as well as removal of the internal components of the device if required. The design would further be amenable to integration into a multi-port connector assembly, including the ability to vary the configuration of the internal components associated with each port of the assembly individually.

SUMMARY OF THE INVENTION

The present invention satisfies the aforementioned needs by an improved modular connector apparatus and method for manufacturing the same.

In a first aspect of the invention, an improved connector assembly for use on, inter alia, a printed circuit board or other device is disclosed. The connector assembly generally comprises a connector housing having a single port; an insertion assembly having (i) an insert element, (ii) a plurality of first and second conductors mated to the insert element; and (iii) at least one substrate disposed in the housing in proximity to the insert element, the substrate having at least one electrical component disposed thereon and in the electrical pathway between the first conductors and the second conductors. In one exemplary embodiment, the insert assembly is substantially planar, and includes a plurality of cavities or recesses adapted to receive carriers formed around the respective sets of conductors. The insert assembly receives the substrate (and electrical component (s)) such that direct electrical connection with the first and second sets of conductors is accomplished within a minimum amount of space, and with minimal conductor length. Light sources (e.g., LEDs) are optionally disposed within apertures in the front of the housing and electrically terminated to traces on the substrate, these traces being terminated to a third set of conductors disposed within a carrier in the rear portion of the insert assembly.

In a second exemplary embodiment, the assembly comprises a connector housing having a plurality of connectors arranged in side-by-side ("1×N") configuration, each of the connectors incorporating the insert assembly described above. The insert assemblies for each respective port may be uniform in configuration, or alternatively may be varied as desired to provide differing functionality.

In a second aspect of the invention, an improved insert assembly for use with a modular connector is disclosed. In one exemplary embodiment, the insert assembly comprises a molded low-profile insert element having a plurality of cavities formed therein; a plurality of first conductors adapted for mating with respective terminals of a modular plug, at least a portion of the first conductors being received within a first of said cavity; a plurality of second conductors adapted for electrical interface with an external device, the second conductors being disposed at least partly within a second of the cavities; and a substrate communicating with the insert element and having a plurality of conductive traces associated therewith, the conductive traces forming electrical pathways between at least some of the first and second conductors. In a second embodiment, the assembly further includes a plurality of light sources electrically communicating with traces on the substrate, and third set of conductors in communication with the traces, thereby forming an electrical path through the connector assembly with the light sources.

In a third aspect of the invention, an improved insert element adapted for use in the modular connector insert assembly previously described is disclosed. In one exemplary embodiment, the insert element comprises an insert body having: (i) a front portion having a first cavity formed therein, and a plurality of first apertures formed within the front portion and communicating with the first cavity, the first apertures being adapted to receive respective ones of the first conductors; (ii) a rear portion having at least a second cavity formed therein, and a plurality of second apertures formed in the rear portion and communicating with the second cavity, the second apertures being adapted to receive respective ones of the second conductors; and (iii) at least one surface adapted to communicate with the internal substrate, the surface being disposed proximate to the first and second apertures, thereby allowing direct connection of conductive traces of the substrate with the first and second conductors.

In a fourth aspect of the invention, an improved electronic assembly utilizing the aforementioned connector assembly is disclosed. In one exemplary embodiment, the electronic assembly comprises the foregoing connector assembly which is mounted to a printed circuit board (PCB) substrate having a plurality of conductive traces formed thereon, and bonded thereto using a reflow soldering process, thereby forming a conductive pathway from the traces through the conductors of the respective conductors of the assembly and modular plug terminals. In another embodiment, the connector assembly is mounted on an intermediary substrate, the latter being mounted to a PCB or other component using a reduced footprint terminal array.

In a fifth aspect of the invention, an improved method of manufacturing the connector assembly of the present invention is disclosed. The method generally comprises: forming an insert element having a plurality of recesses and adapted to be received within the connector housing; forming a plurality of first conductors; providing a plurality of second conductors; providing a substrate; forming a plurality of conductive traces upon the substrate; inserting a portion of the first and second conductors within respective ones of said recesses; and positioning the substrate proximate to the insert element such that the first and second conductors are in electrical communication via the conductive traces of the substrate.

BRIEF DESCRIPTION OF THE DRAWINGS

The features, objectives, and advantages of the invention will become more apparent from the detailed description set forth below when taken in conjunction with the drawings, wherein.

DETAILED DESCRIPTION OF THE PREFERRED EMBODIMENTS

Reference is now made to the drawings wherein like numerals refer to like parts throughout.

It is noted that while the following description is cast primarily in terms of one or a plurality of RJ-type connectors and associated modular plugs of the type well known in the art, the present invention may be used in conjunction with any number of different connector types. Accordingly, the following discussion of the RJ connectors and plugs is merely exemplary of the broader concepts.

As used herein, the terms "electrical component" and "electronic component" are used interchangeably and refer to components adapted to provide some electrical function, including without limitation inductive reactors ("choke coils"), transformers, filters, gapped core toroids, inductors, capacitors, resistors, operational amplifiers, transistors and diodes, whether discrete components or integrated circuits, whether alone or in combination. For example, the improved toroidal device disclosed in co-Assignee's co-pending U.S. patent application Ser. No. 09/661,628 entitled "Advanced Electronic Microminiature Coil and Method of Manufacturing" filed Sep. 13, 2000, which is incorporated herein by reference in its entirety, may be used in conjunction with the invention disclosed herein.

Furthermore, so-called "interlock base" assemblies such as those manufactured by the Assignee hereof and described in detail in, inter alia, U.S. Pat. No. 5,015,981 entitled "Electronic Microminiature Packaging and Method", issued May 14, 1991, and incorporated by reference herein in its entirety, may be used.

As used herein, the term "signal conditioning" or "conditioning" shall be understood to include, but not be limited to, signal voltage transformation, filtering, current limiting, sampling, processing, splitting, and time delay.

As used herein, the term "port group" refers to a 1×N row modular connector in which the ports are in a substantially side-by-side arrangement; i.e., one port disposed substantially adjacent the other port or ports, respectively.

Single Port Embodiment

Referring now to FIGS. 1*a*–4*c*, a first embodiment of the connector assembly of the present invention is described. As shown in FIGS. 1*a*–1*d*, the assembly 100 generally comprises a connector housing element 102 having a modular plug-receiving recess 108 formed therein, as well as two recesses 105*a*, 105*b* for light-emitting diodes (LEDs) or other light sources. The LEDs are used to indicate the status of the electrical connection within each connector, as is well understood. It will be recognized that while the illustrated embodiment includes LEDs or other light sources, such features are entirely optional, and accordingly the present embodiment is merely illustrative of the broader concepts of the invention.

Figure 1A:
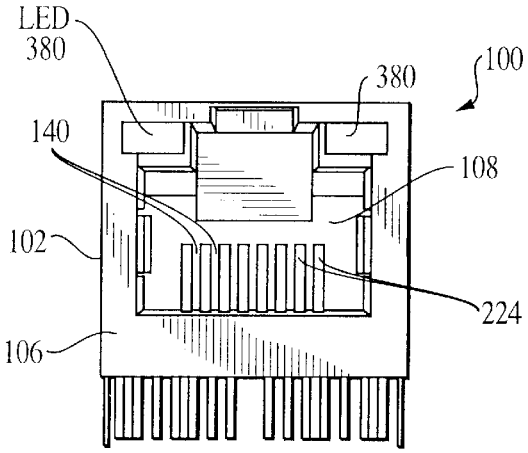
FIG. 1*a* is a front plan view of a first exemplary embodiment (single port) of the connector assembly according to the present invention.
Figure 1B:
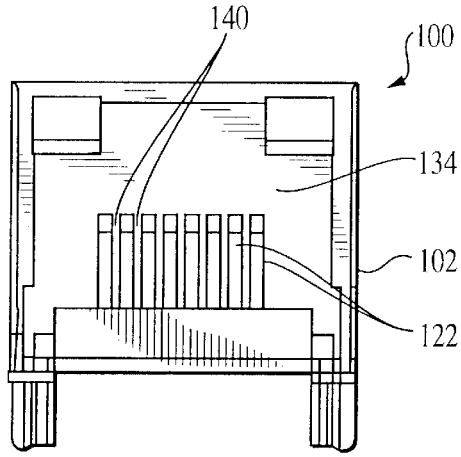
FIG. 1*b* is a rear plan view of the connector assembly of FIG. 1*a* without insert assembly.
Figure 1C:
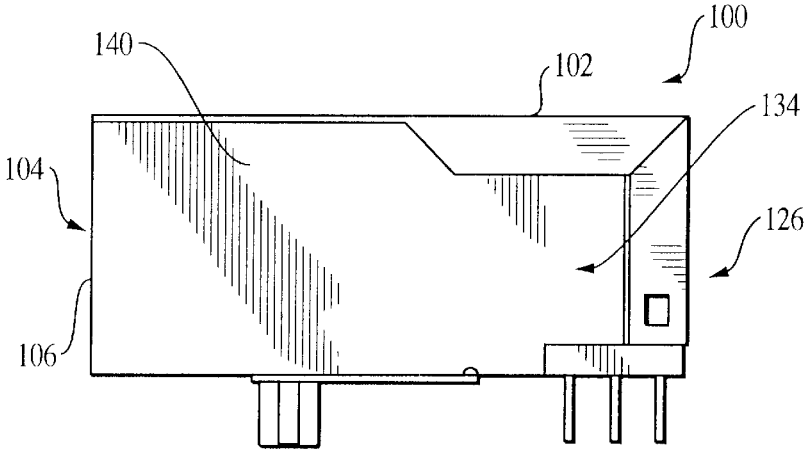
FIG. 1*c* is a side plan view of the connector assembly of FIG. 1*a* with insert assembly and optional external noise shield installed.

As shown in FIG. 1*c*, the front or forward wall 106 of the connector 100 is further disposed generally perpendicular or orthogonal to the PCB surface (or other device) to which the connector assembly 100 is mounted, with the latch mechanism located away from the PCB (so-called "latch up"), such that modular plugs may be inserted into the plug recesses 108 formed in the connectors 104 without physical interference with the PCB, although this orientation may be inverted if desired. The plug recess 108 is adapted to receive one modular plug (not shown) having a first plurality of electrical conductors disposed therein in a predetermined array, the array being so adapted to mate with respective contact portions 224 of conductors 212 present in the recesses 108, thereby forming an electrical connection between the plug conductors and connector conductors 212, as described in greater detail below. The connector housing element 102 and the molded body element 400 are in the illustrated embodiment electrically non-conductive and is formed from a thermoplastic (e.g. PCT Thermex, IR compatible, UL94V-0), although it will recognized that other materials, polymer or otherwise, may conceivably be used. An injection molding process is used to form the housing element 102 and the molded insert element 400 (described below in greater detail), although other processes (such as transfer molding) may be used, depending on the material chosen. The selection and manufacture of the housing element and molded body element is well understood in the art, and accordingly will not be described further herein.

Also formed generally within the recess 108 in the housing element 102 are a plurality of grooves 122 which are disposed generally parallel and oriented substantially horizontally within the housing 102. The grooves 122 are spaced and adapted to guide and receive the aforementioned conductors 212 used to mate with the conductors of the modular plug. The housing element 102 includes a cavity 134 formed in the back of the connector 104 generally adjacent to the rear wall, the cavity 134 being adapted to receive an insertion assembly 300 (described in detail below with respect to FIG. 3*a*) in a substantially horizontal orientation with the plane of the insertion assembly 300 being substantially parallel with the direction of the run of the longitudinal conductors 225 (i.e. front to back within the housing 102). The conductors 212 and insert element 400 comprise a substantially planar component when assembled.

Figure 1D:
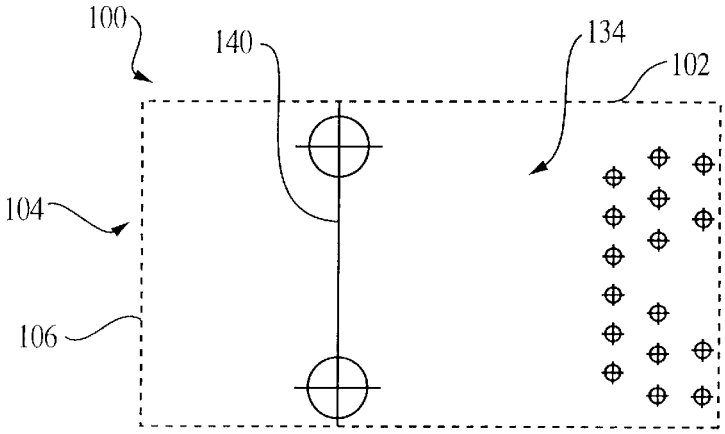
FIG. 1*d* is a bottom plan view of the connector assembly of FIG. 1*a* with insert assembly according to the present invention.

The housing element also includes a plurality of positioning elements 109 formed on the bottom face of the housing 109 as shown in FIGS. 1*c* and 1*d*. These positioning elements 109 in the illustrated embodiment comprise stakes having a "T" shaped cross-section and molded as part of the housing element 102, although other configurations may be used. For example, the "split pin" arrangement disclosed in U.S. Pat. No. 6,116,963 entitled "Two Piece Microelectronic Connector and Method" issued Sep. 12, 2000, incorporated by reference herein in its entirety, could be substituted. Alternatively, the positioning elements may have different cross-sectional shape, be tapered, be separable from and/or made of different from the housing element 102, etc.

The conductors 212 are formed in a predetermined shape, including contact portion 224, longitudinal portion 225, and interface portion 218 (see FIG. 2*e*), and held within first and second carrier elements 216, 220 (see FIG. 2*a*), the latter also mating with the housing element 102. The conductors 212 further optionally include a stress relief and fulcrum portion 214 which is specially shaped to add resiliency and bias the distal ends of the conductor contact portions 224 into contact with the corresponding modular plug contacts. As used herein, the term "carrier" is meant to refer to structures used to provide a predetermined function with respect to one or more conductors or terminals, such as the exemplary structures 216, 220 molded around the conductors 212 in the embodiment of FIGS. 1*a*–4*c*; however other types and forms of structure may be used.

It will also be recognized that positioning or retaining elements (e.g., "contour" elements), as described in the aforementioned U.S. Pat. No. 6,116,963 entitled "Two Piece Microelectronic Connector and Method", may optionally be utilized as part of the housing element 102 of the present invention, and even in lieu of the foregoing carrier arrangement. These positioning or retaining elements are used in conjunction with corresponding bends in the conductors 212 to, inter alia, position the individual conductors 212 with respect to the modular plug(s) received within the recess 108. Additionally, or in the alternative, these contour elements (and bends) may act as retaining devices for the conductors 212 and associated insert assembly 300, thereby providing a frictional retaining force that opposes removal of the assembly and conductors from the housing 102.

Figure 2A:
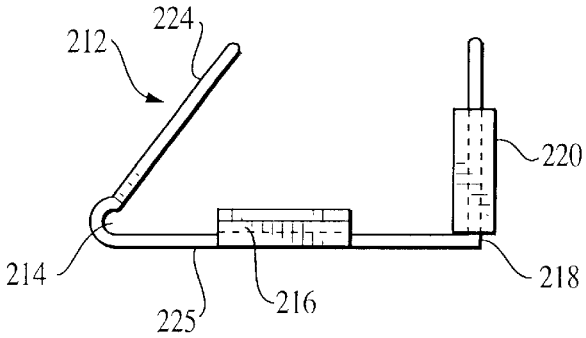
FIG. 2*a* is a side plan view of the conductor assembly and associated carriers used as part of the insertion assembly of the connector of FIG. 1*a*.
Figure 2B:
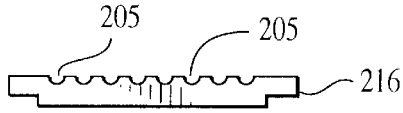
FIG. 2*b* is a front plan view of one exemplary embodiment of the forward carrier element used on the conductor assembly of FIG. 2*a*.
Figure 2C:
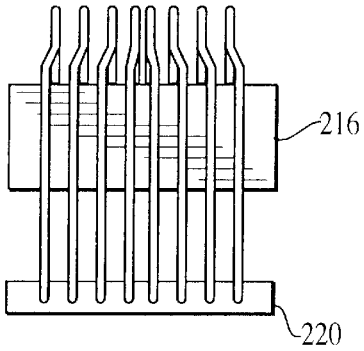
FIG. 2*c* is a bottom plan view of the conductor assembly of FIG. 2*a*.
Figure 2D:
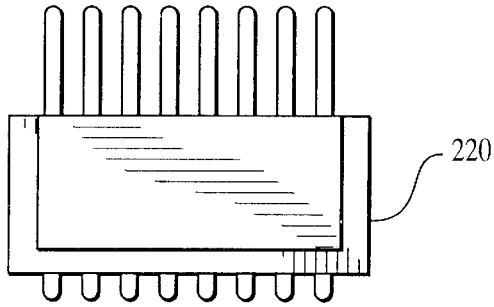
FIG. 2*d* is a rear plan view of the conductor assembly of FIG. 2*a*.
Figure 2E:
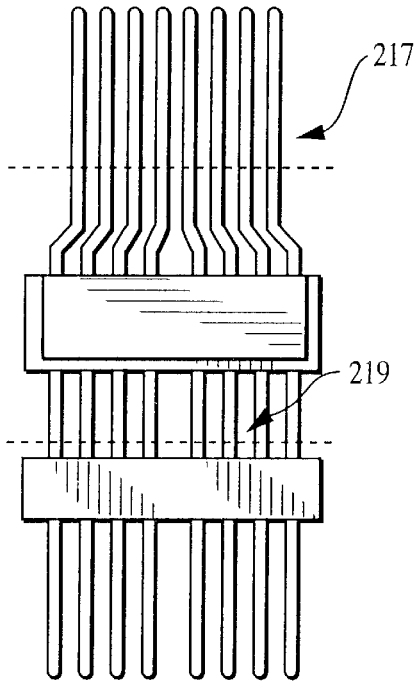
FIG. 2*e* is a top plan view of the conductor assembly of FIG. 2*a*, shown during an intermediary step of the manufacturing process and before deformation of the conductors.

Additionally, as shown in FIG. 2*e*, the spacing 219 between individual ones of the conductors 212 is varied along their length such that appropriate spacing for mating with the contacts of the modular plug (not shown), nominally 40 mils (0.040 in.) although other values may be used, is provided at the contact portions 224 of the conductors 212, and greater spacing (e.g., 50 mils) is maintained at the point of attachment for the first and second carriers 216, 220, thereby reducing electrical cross-talk and other deleterious effects, and facilitating lower cost manufacturing.

FIG. 2*b* illustrates one exemplary embodiment of the first (forward) carrier 216. Specifically, the carrier 216 comprises a substantially planar body, having two tabs 207 disposed on either end, the tabs 207 each being lesser in thickness than (or "stepped down" from) the central portion 209, with the bottom face 211 of the central portion 209 being flush with the bottom faces of the tabs 207, such that a uniform flat surface is formed. A plurality of channels or grooves 205 are formed within the bottom face 211 of the carrier 216 so as to receive respective ones of the longitudinal portions 225 of the conductors 212. The two tabs 207 are adapted so as to slide within complementary grooves 111 (FIG. 1*b*) located at the forward lower edge of the cavity 134, such that carrier 216, and therefore conductors 212, are guided and registered into proper position within the cavity when the insert assembly 300 is fully inserted therein. It will be recognized, however, that other mechanisms or configurations of carrier guidance mechanisms, or if desired no guidance mechanism at all, may be employed consistent with the invention. For example, small pins or stakes formed on the forward edge of the carrier (not shown) could be used in conjunction with complementary apertures formed in the rear surface of the forward housing cavity wall to register the carrier upon insertion. As yet another alternative, a single pin or key (not shown) could be formed on the bottom surface 211 of the carrier 216 to cooperate with a complementary groove formed longitudinally within the bottom interior wall of the cavity 134 so as to laterally align the carrier 216 (and conductors) with respect to the aforementioned grooves 122 upon assembly. Myriad other techniques and configurations could also be utilized, all other such techniques and configurations being known to and implemented by those of ordinary skill.

In the illustrated embodiment of FIGS. 2*a*–2*e*, the carrier elements 216, 220 are molded onto the conductors 212 prior to deformation of the latter as shown best in FIG. 2*e*, although other techniques may be used. For example, one or more of the carrier elements 216, 220 may be molded in advance (with the corresponding apertures or slots formed therein to receive respective ones of the conductors), and the carriers 216, 220 slid or clipped onto the conductors. In another variant, the carrier element is comprised of two half-pieces which fit together (e.g., snap-fit) around the conductors. Yet other approaches may be used, such as for example molding of the carrier onto the conductors after the latter have been formed to the desired shape.

It is further noted that as shown in FIG. 2*e*, the first carrier 216 of the illustrated embodiment is molded such that the bottom surface 211 of that carrier 216 is effectively flush with the bottom surface of the longitudinal portion 225 of the conductors 212, thereby advantageously economizing on space within the interior of the housing element 102, and allowing the lowest possible overall profile for the connector.

Figure 3A:
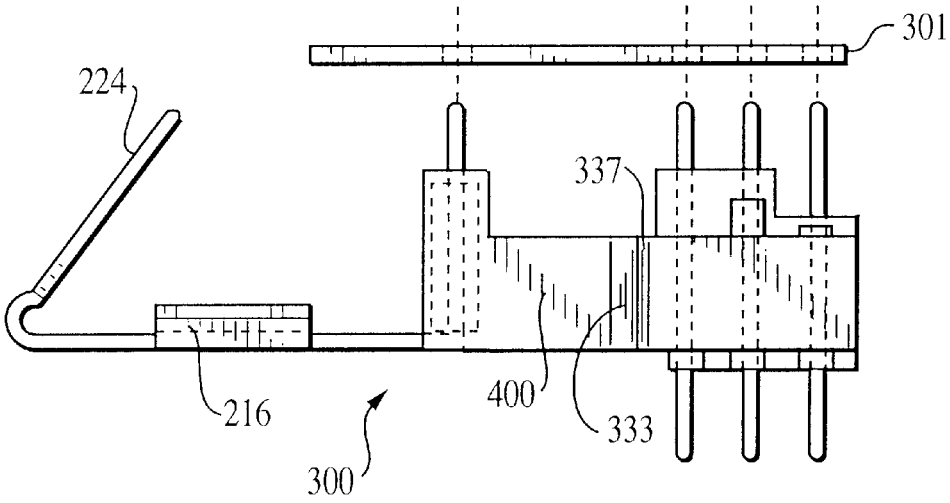
FIG. 3*a* is a side plan view of the insert assembly of the connector of FIG. 1, with substrate (and LEDs) removed.
Figure 3B:
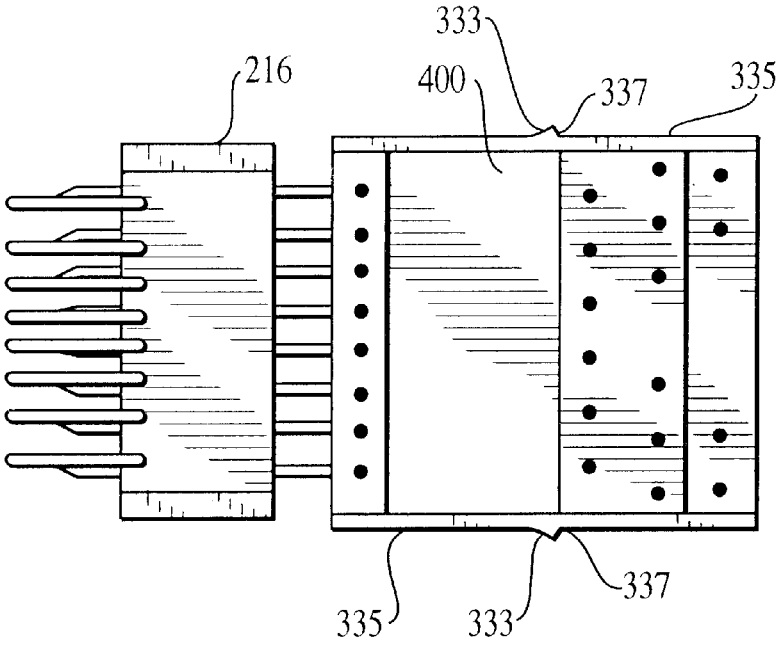
FIG. 3*b* is a top plan view of the insert assembly according to FIG. 3*a*.

The cavity 134 of the housing element 102 is also sized in width by approximately the width of the molded insertion element 400, a component of the aforementioned insertion assembly 300 (see FIGS. 3*a* and 3*b*). The cavity 134 is also sized in depth by approximately the length of the insertion assembly 300. As previously described, the conductor contact portions 224 of the insertion assembly 300 are deformed such that when the insertion assembly 300 is inserted into its cavity 134, the contact portions 224 are received within the grooves 122 and maintained in position to mate with the conductors of the modular plug. The position of the molded insertion element 400 is further offset toward the bottom wall of the housing element 102 thereby allowing (i) any electrical components disposed directly or indirectly on the element 400 to fit entirely within the cavity 134, and resultantly a "standard" connector housing profile; and (ii) the simultaneous placement of the insertion assembly 300 within the housing at the same time (including the electrical components associated with each, if provided).

This offset is accomplished in the illustrated embodiment through the use of two longitudinal channels 121 which are formed in the interior side walls of the housing element 102, disposed roughly at the lower edge, as shown best in FIG. 1*b*. Specifically, the channels 121 each are sized to receive a tab 333 formed on the sidewall 335 of the insertion element 400, as best shown in FIGS. 3*a* and 3*b*. The vertical height of the channels 121 is made so as to be slightly larger than that of the corresponding tabs 333, such that the tabs 333 slide smoothly but in directed fashion within the channels 121, thereby allowing the insert assembly 300 to move into proper position within the cavity 134. The overall width of the insert element 400 (as measured at the outward-most points of the tabs 333) is less than that distance between the opposing faces of the two channels 121, but greater than that of the two opposing faces of the interior walls of the housing element 102 within the cavity, such that the insert assembly 300 slides smoothly but firmly, and without any significant rotation, into place within the housing element 102. This arrangement further helps guide the forward carrier 216 into position within its channels 111, since the tabs 207 on the carrier 216 are constrained to travel within the longitudinal channels 121 while the assembly 300 is being inserted.

The tabs 333 of the illustrated embodiment are also made "wedge" shaped or tapered on their forward edge such that the rear edge 337 of each tab 333 engages a corresponding edge of a recess (not shown) formed within each channel 121. The placement of the recess(es) is such that when the insert assembly 300 is fully received within the cavity 134, the tabs 333 fall within their respective recesses, with the rear tab edges 337 cooperating with the rear edges of their respective recess to prevent withdrawal of the assembly 300 from the housing 102. Accordingly, the insert assembly effectively "snaps into" the housing when fully inserted therein. To remove the assembly 300 from the housing 102, the sidewalls of the housing 102 are made thin and flexible enough such that sufficient deformation may occur to release the tabs 333 during retraction of the assembly 300. Specifically, the user simply grasps and spreads the sidewalls outward somewhat (e.g., by using the fingernails of there two respective thumbs) while pushing the insert assembly rearward, thereby unlocking the assembly from the housing. Other mechanisms may be used, however, to facilitate locking/unlocking of the assembly 300 within the housing 102, such mechanisms being readily implemented by those of ordinary skill.

As shown in FIGS. 3*a*–4*c*, the insert element 400 further includes a rear terminal carrier receiving portion 408 and a terminal front terminal carrier receiving portion 410, each generally comprising one or more cavities 412, 414, 416, 418 with corresponding conductor apertures 420*a*–*d*, formed in the underside 421 of the element 400. The front carrier receiving portion 410 and associated cavity 412 is adapted to receive the second carrier 220 and associated interface portion 218 of the conductors 212, the latter being effectively vertical in orientation to facilitate being received within the cavity 412 and conductor apertures 420*a*. In the illustrated embodiment, the second carrier 220 and conductor interface portions 218 are frictionally received within the cavity 412 and apertures 420*a*, although it will be recognized that such frictional relationship need not exist, or alternatively adhesive, heat-bonding, or other technique may be used to retain the relative positioning of the carrier 220 and insert element 400. Friction is used in the illustrated embodiment to permit firm registration and capture of the carrier 220 within the insert element 400, yet advantageously (i) simplify the manufacturing process, since no additional assembly steps are required; (ii) reduce cost, since no adhesive or special heat bonding equipment is required; and (iii) allow subsequent removal of the carrier 220 and conductors 212 from the element 400 if desired.

The front wall 411 of the front portion 410 of the element 400 further includes a notched or cutout portion (not shown) adapted to receive the parallel array of longitudinal portions 225 of the conductors 212, thereby allowing the bottom surface of the conductor portions 225 and the bottom surface of the insert element 400 (as well as the bottom surface of the first carrier 216) to be coplanar, as shown in FIG. 3*a*. This allows for a lower connector vertical profile than would otherwise be achievable without the use of such a cutout.

Figure 4A:
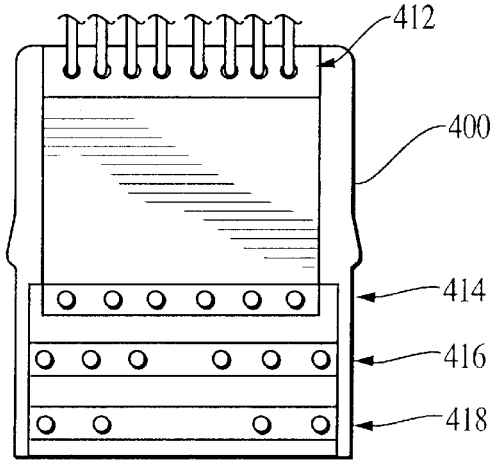
FIG. 4*a* is bottom plan view of the insert element used within the insert assembly of FIG. 3*a*.
Figure 4B:
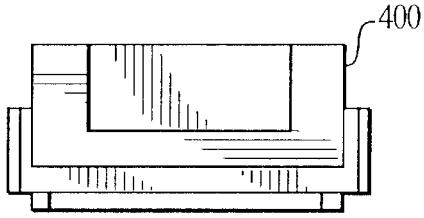
FIG. 4*b* is a front plan view of the insert element of FIG. 4*a*, with terminal carriers removed.
Figure 4C:
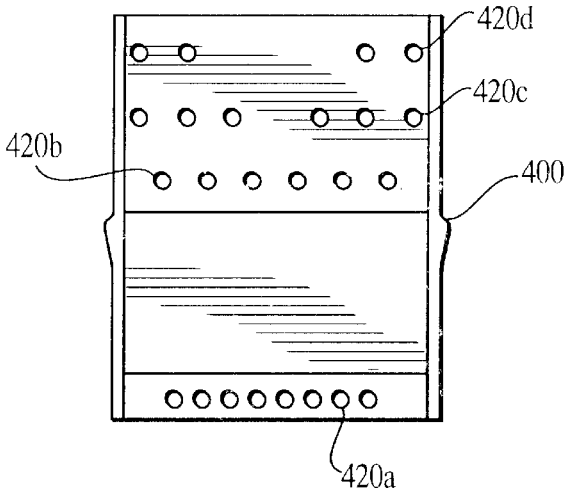
FIG. 4*c* is a top plan view of the insert element of FIG. 4*a*, showing the terminal apertures formed in the upper surfaces thereof.

Within the rear terminal carrier receiving portion 408, three cavities 414, 416, 418 are formed in the underside surface 421 of the element 400 in front-to-back vertical orientation, as shown in FIG. 4*a*. The forward two of these three cavities 414, 416 are meant to receive terminal carriers 450, 452 (described below with respect to FIGS. 4*d*–4*g*) associated with the signal path of the connector and any electronic or signal conditioning components used therein. The rear-most of these cavities 418 is adapted to receive the light-emitting diode (LED) conductor carrier 454, also described in detail subsequently herein. As with the forward portion cavity 412, these three rear cavities 414, 416, 418 have respective sets of a plurality of apertures 420*b*–*d* formed in the top surfaces 423*b*–*c* of the rear portion 408 of the insert element 400 as best shown in FIG. 3*b*. In the illustrated embodiment, the aperture sets 420*b*–*d* form linear groups or rows of apertures, although other patterns or arrays may be used depending on the particular application and specification to which the connector is manufactured. Specifically, the two forward-most aperture sets 420*b*, 420*c* in the rear portion 408 form respective single rows of six apertures each, the second row set 420*c* having a gap formed in the middle such that the effective width of that row is greater than that of the first aperture row set 420*b*. The apertures 420*d* in the LED conductor carrier comprise two sets of two apertures each, corresponding to the two conductors associated with each of the two LEDs. As will be discussed in greater detail below, however, this last carrier cavity 418 and associated apertures 420*d* may be obviated when the connector application does not require LEDs, or alternatively when another light source configuration is used.

Figure 4D:
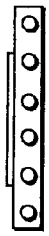
FIG. 4*d* is a top plan view of the forward (signal path) terminal carrier of the insert assembly of FIG. 3*a*.
Figure 4E:
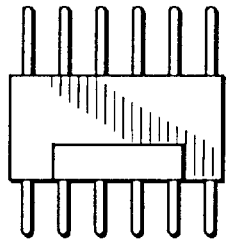
FIG. 4*e* is a front plan view of the forward (signal path) terminal carrier of the insert assembly of FIG. 3*a*.

The construction of the three terminal carriers is now described in detail with respect to FIGS. 4*d*–4*i*. FIGS. 4*d* and 4*e* show an exemplary embodiment of the forward-most terminal carrier 450, used to carry one set of signal path terminals 460. The carrier 450 comprises a molded polymer body 456 adapted to frictionally fit within the insert element cavity 412, and a plurality (six) of terminals 460 adapted to fit through the apertures 420*b* formed in the insert element 400. The length of the terminals 460 protruding above the body 456 is adjusted so as to provide proper registration with the substrate (PCB) 301 of FIG. 3*a*, while the length below is adjusted to provide proper registration with the parent device (e.g., PCB) onto which the connector 100 is mounted.

Figure 4F:
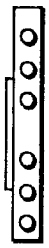
FIG. 4*f* is a top plan view of the intermediate (signal path) terminal carrier of the insert assembly of FIG. 3*a*.
Figure 4G:
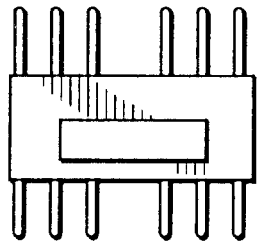
FIG. 4*g* is a front plan view of the intermediate (signal path) terminal carrier of the insert assembly of FIG. 3*a*.

FIGS. 4*f* and 4*g* illustrate the middle carrier 452 also used to carry a second plurality (six) of signal path terminals 462 in similar fashion to the first (forward-most) carrier 450 previously described. This carrier 452 is effectively identical to the forward-most of the rear portion carriers 452, with the exception that its terminals 462 are spaced differently, and its overall width is greater (to accommodate the greater terminal spacing).

Figure 4H:
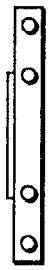
FIG. 4*h* is a top plan view of the rear (LED) terminal carrier of the insert assembly of FIG. 3*a*.
Figure 4I:
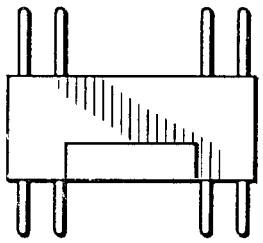
FIG. 4*i* is a front plan view of the rear (LED) terminal carrier of the insert assembly of FIG. 3*a*.

FIGS. 4*h* and 4*i* illustrate the rear-most (LED) terminal carrier 454 of the insert assembly 300, which is generally similar in construction to the two aforementioned terminal carriers 450, 452, with the exception that the LED terminal carrier has four terminals 464 corresponding to the four conductors of the LEDs 380 (described below).

As shown in FIG. 3*a*, the insert assembly 300 further includes a substrate element 301 which is disposed horizontally and in substantially coplanar orientation with the insert element 400. In the illustrated embodiment, the substrate element 301 comprises a printed circuit board (PCB) having a plurality of terminal apertures and/or surface mount contact pads and conductive traces of the type well known in the art, although other substrate technologies may be substituted. The apertures 303 of the substrate 301 are positioned so as to align with the various terminals of the three terminal carriers 450, 452, 454 of the insert assembly 300, as well as the interface portions 218 of the conductors 212, when the substrate 301 is positioned on the insert assembly 300. The top surfaces 423*a*–*b* of the forward and rear portions of the insert element 400 are made substantially coplanar in the present embodiment, such that the substrate 301, when placed atop the element 400, is substantially parallel with the bottom surface 421 of the insert element 400. The substrate 301 is further sized and configured such that it (and the rest of the insert assembly 300) fit easily within the cavity 134 of the housing element 102.

The substrate 301 of the illustrated embodiment further includes a plurality of electronic components 345 disposed on the upper surface 303 of the substrate 301, their conductive pathways in contact with the pads/traces of the substrate, thereby forming electrical pathways from the contact portions 224 of the conductors 212 through the components 345 and to the terminals 460 and ultimately the device to which the connector 100 is mounted. Electrical components may be disposed on either or both sides of the internal substrate 301 if desired, consistent with available room in the housing cavity 134. For example, in another exemplary embodiment, the electrical components mounted on each primary substrate are divided into two general groups for purposes of electrical isolation; e.g., resistors and capacitors are disposed on one side of the primary substrate, while the magnetics (e.g., choke coils, toroid core transformers, etc.) are disposed on the other side of the primary substrate. The electrical components are further encapsulated in silicon or similar encapsulant for both mechanical stability and electrical isolation. Any number of different component configurations (whether discrete, grouped, or integrated) of the type well known in the art may be utilized in conjunction with the substrate 301 of the invention.

Furthermore, it will be recognized that the electrical components described above need not be mounted on the substrate 301; rather, in an alternate embodiment (not shown), no electrical components are placed in the electrical pathways between the conductors 212 and the terminals 460, 462, 464, and are replaced with uninterrupted runs of conductive traces on the substrate. In this fashion, the substrate acts merely to provide a plurality of conductive pathways between the conductors 212 and the terminals. Other configurations are also possible.

Figure 3C:
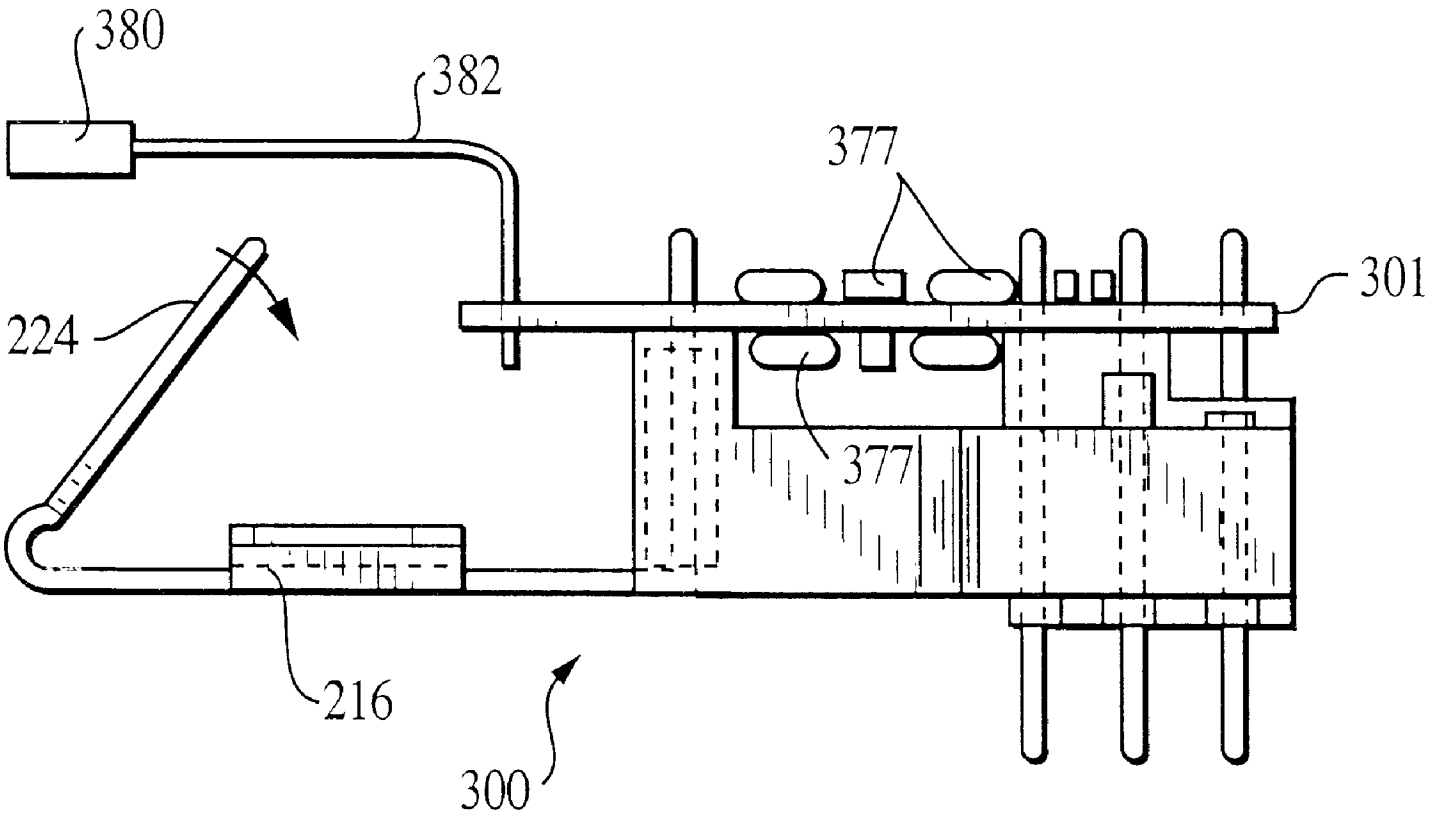
FIG. 3*c* is a side plan assembly view of the insert assembly of FIG. 3*a*, including substrate, LEDs, and electronic components.

As shown in FIG. 3*c*, the insert assembly 300 (and specifically the substrate 301) further functions to interface the conductors 382 of the light emitting diodes 380 with the terminals 464 of the rear-most terminal carrier 454, thereby forming an electrical path between the terminals 464 and LED conductors 382 via the traces on the substrate 301. A variety of different electronic components 377 are disposed on the substrate 301 as well. In the illustrated embodiment, the LED conductors 382 are deformed and inserted into apertures in the substrate 301, and then bonded thereto using reflow solder processing or the like. This arrangement advantageously reduces the length of the conductors 382 of the LEDs, thereby mitigating their radiated noise.

The recesses 105*a*, 105*b* formed within the housing element 102 each encompass their respective LED 380*a*, 380*b* when the latter is inserted therein, and securely hold the LED in place via friction between the LED and the inner walls of the recess (not shown). Alternatively, a looser fit and adhesive may be used, or both friction and adhesive.

Many other configurations for locating and retaining the LEDs 380 in position with respect to the housing element 102 may be used, such configurations being well known in the relevant art.

The two LEDs 380 used for each connector 100 radiate visible light of the desired wavelength(s), such as green light from one LED and red light from the other, although multi-chromatic devices (such as a "white light" LED), or even other types of light sources, may be substituted if desired. Many other alternatives such as incandescent lights or even liquid crystal (LCD) or thin film transistor (TFT) devices are possible, all being well known in the electronic arts.

The connector assembly 100 with LEDs 380 may further be configured to include noise shielding for the individual LEDs if desired. If it is desired to shield the individual connectors 100 and their associated conductors and components from noise radiated by the LEDs, such shielding may be included within the connector assembly 100 in any number of different ways. In one embodiment, the LED shielding is accomplished by forming a thin metallic (e.g., copper, nickel, or copper-zinc alloy) layer on the interior walls of the LED recesses 105*a*, 105*b*, or even over the non-conductive portions of LED itself, prior to insertion of each LED. In a second embodiment, a discrete shield element (not shown) which is separable from the connector housing element 102 can be used, each shield element being formed so as to accommodate it's respective LED and also fit within its respective recess 105*a*, 105*b*. Myriad other approaches for shielding the connector internals from the LEDs may be used as well if desired, with the only constraint being sufficient electrical separation between the LED conductors and other metallic components on the connector assembly to avoid electrical shorting.

It will also be understood that the placement of the light sources within the connector housing 102 may be varied. For example, the LEDs 380 could be placed in a different location, such as on the rear of the substrate 301 of the connector (not shown), in tandem arrangement, with respective optical media such as light pipes of the type well known in the art being routed to the desired viewing face location.

It will be appreciated that one of the benefits afforded by the foregoing arrangement of components within the connector 100 is the reduced conductor/terminal length and forming required. Specifically, with respect to the terminals 460, 460, 464, effectively straight terminals are used, thereby obviating manufacturing steps of forming these terminals and reducing connector cost. Additionally, the placement of the substrate 301 directly in proximity to the insert element 400 reduces the length of the terminals 460, 462, 464 and conductors 212 within the connector 100, thereby helping to reduce susceptibility to EMI and other noise sources.

Multi-Port Embodiment

Figure 5:
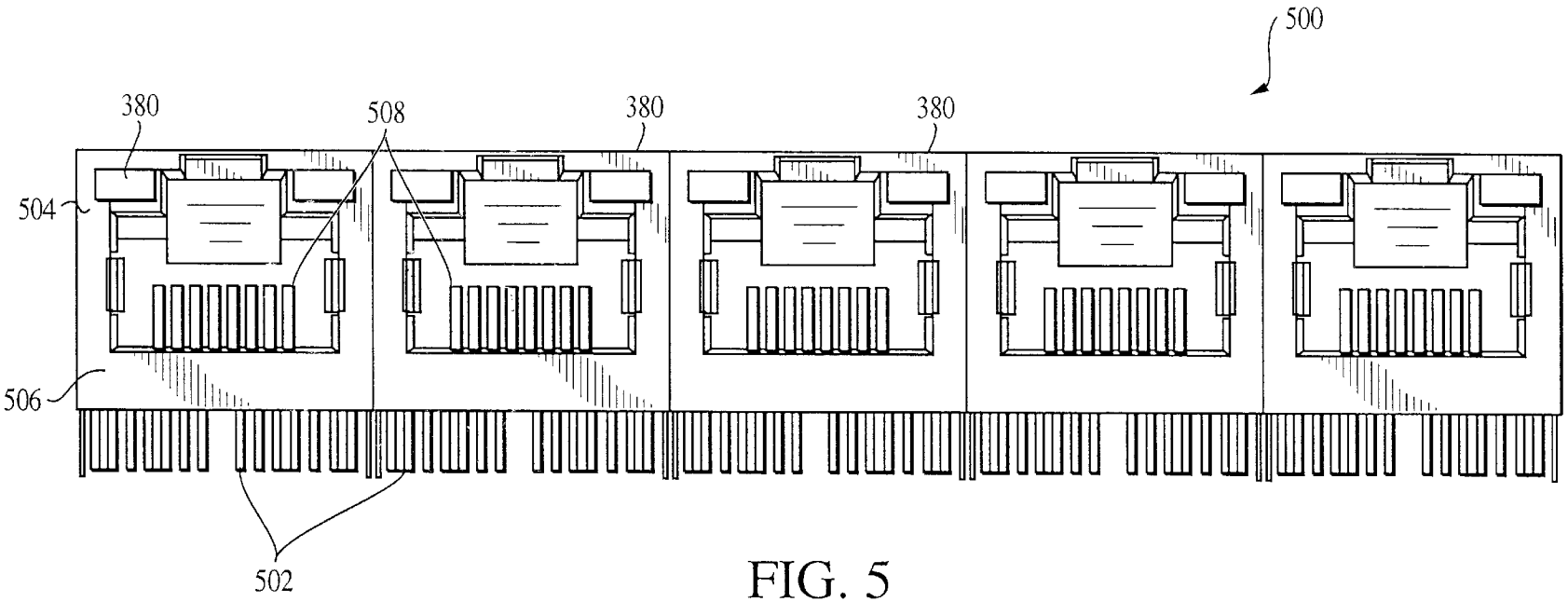
FIG. 5 is a front plan view of a second embodiment of the connector assembly of the invention having a plurality of modular connectors arranged in a 1×N array.

Referring now to FIG. 5, a second embodiment of the connector assembly of the present invention is described. As shown in FIG. 5, the assembly 500 generally comprises a connector housing element 504 having a plurality of individual connectors 502 formed therein (i.e., a "1×N" row). Specifically, the connectors 502 are arranged in the illustrated embodiment in side-by-side row fashion within the housing 504, one disposed adjacent the other. The front walls 506 of each individual connector are further disposed parallel to one another and generally coplanar, such that modular plugs may be inserted into the plug recesses 108 formed in each connector 502 simultaneously without physical interference. The plug recesses 108 are each adapted to receive one modular plug (not shown) having a plurality of electrical conductors disposed therein in a predetermined array, the array being so adapted to mate with respective conductors 212 present in each of the recesses 108 thereby forming an electrical connection between the plug contacts and connector conductors 212, as previously described with respect to FIGS. 1*a*–*d* above.

It is further noted that while the embodiment of FIG. 5 comprises a row 500 of four connectors 504 each (thereby forming a 1-by-4 array of connectors), other array configurations may be used. For example, a 1-by-8 arrangement could be used. The modular plug recesses 108 (and front faces 506) of each connector also need not necessarily be coplanar as in the embodiment of FIG. 5. Furthermore, certain connectors in the array need not have electronic components, or alternatively may have components disposed on the insertion assemblies 300 different than those for other connectors in the same array.

The row of connectors may also be configured such that the latching mechanisms for each connector is reversed in orientation. That is, the flexible tab and recess arrangement of the type commonly used on RJ modular jacks (although other types may be substituted) may be configured in "latch up" or "latch down" arrangement to accommodate ease of use by the operator.

Figure 6:
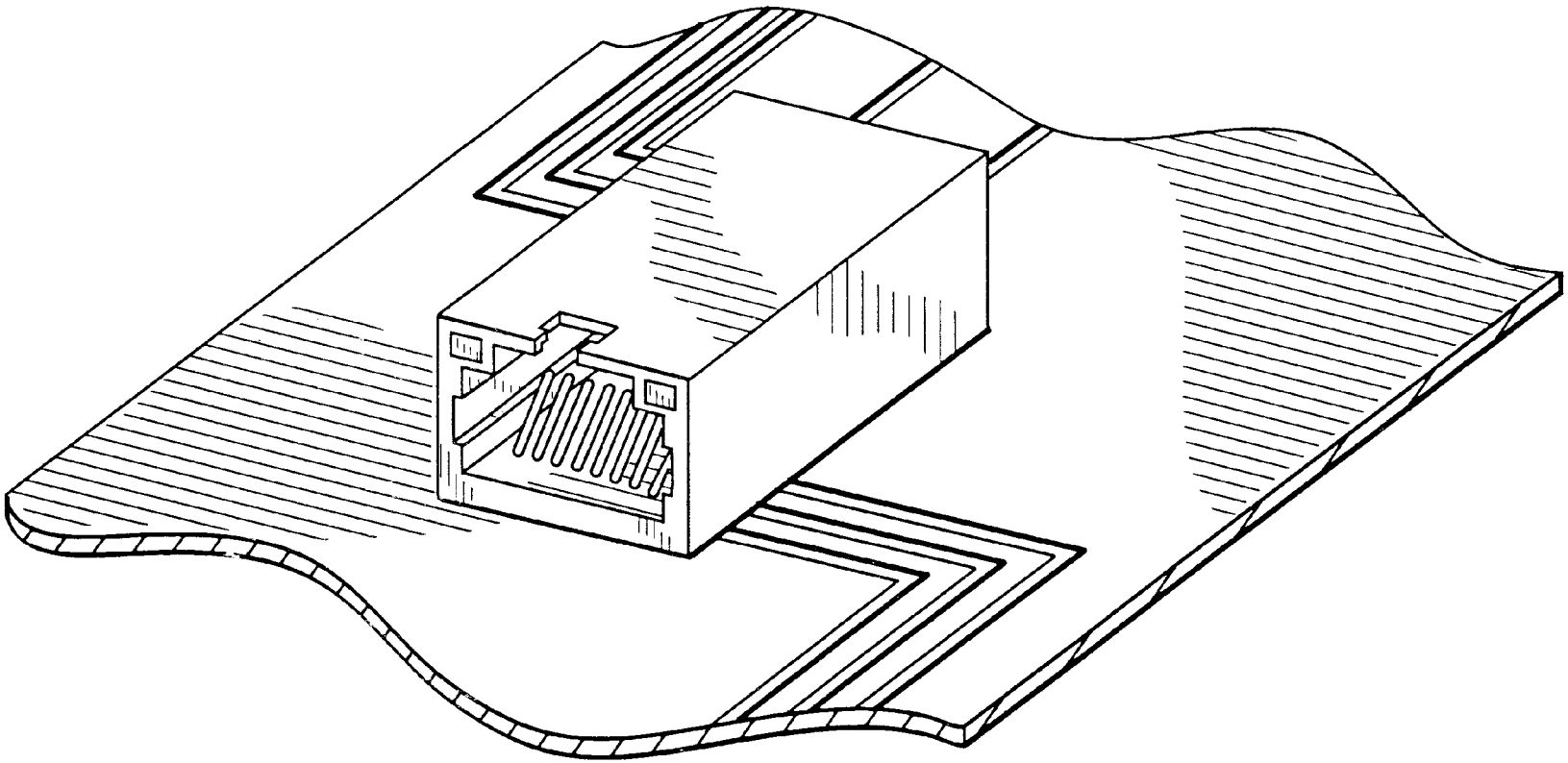
FIG. 6 is a perspective view of the connector of FIGS. 1*a*–4*i*, showing the connector mounted on an external printed circuit board (PCB).

FIG. 6 illustrates the connector assembly of FIGS. 1*a*–4*c* mounted to an external substrate, in this case a PCB. As shown in FIG. 6, the connector assembly 100 is mounted such that the terminals 460, 462, 464 penetrate through respective apertures 610 formed in the PCB 606. The terminals are soldered to the conductive traces 608 immediately surrounding the apertures 610, thereby forming a permanent electrical contact there between. Note that while a conductor/aperture approach is shown in FIG. 6, other mounting techniques and configurations may be used. For example, the terminals 460, 462, 464 may be formed in such a configuration so as to permit surface mounting of the connector assembly 100 to the PCB 606, thereby obviating the need for apertures 610. As another alternative, the connector assembly 100 may be mounted to an intermediary substrate (not shown), the intermediary substrate being mounted to the PCB 606 via a surface mount terminal array such as a ball grid array (BGA), pin grid array (PGA), or other non-surface mount technique. The footprint of the terminal array is reduced with respect to that of the connector assembly 100, and the vertical spacing between the PCB 606 and the intermediary substrate adjusted such that other components may be mounted to the PCB 606 outside of the footprint of the intermediary substrate terminal array but within the footprint of the connector assembly 100.

It will be further noted that each of the foregoing embodiments of the connector assembly of the invention may be outfitted with one or more external or internal noise/EMI shields in order to provide enhanced electrical separation and reduced noise between conductors and electronic components. As an example, the internal shielding arrangement (s) described in co-pending U.S. patent application Ser. No. 09/732,098 entitled "Shielded Microelectronic Connector Assembly and Method of Manufacturing", filed Dec. 6, 2000, and assigned to the co-assignee hereof, incorporated by reference herein in its entirety, may be adapted for use with the present invention, whether alone or in conjunction with other such shielding methods. Specifically, the single- or multi-port port embodiments of the present invention may be fitted with a substrate shields to limit electromagnetic noise transferal through the bottom of the connector. Similarly, side- or lateral shield elements such as those taught in the foregoing application may be used between individual ones of the connectors in the multi-port embodiment of the present invention. An external or "wrap-around" noise shield of the type illustrated in FIG. 1*c* herein, or other comparable design, may be employed in addition or in the alternative to the foregoing internal shields as well.

As yet another option, the LEDs 380 of connector embodiments described herein may further be configured as inserts adapted for receipt within the forward surface of the housing as described in co-pending U.S. patent application Ser. No. 10/140,422 entitled "Connector Assembly with Light Source Sub Assemblies and Method of Manufacturing" filed contemporaneously herewith, assigned to the Assignee hereof, and incorporated by reference herein in its entirety. Using this approach, the majority of LEDs are ganged in groups of two and inserted into complementary recesses formed in the port interstices of the front face of the housing element 504. The LED conductors 382 accordingly are routed in an essentially normal direction with relation to the PCB or other component on which the connector assembly is mounted, thereby minimizing the run length of the conductors, and correspondingly reducing radiated EMI from the conductors 382.

Method of Manufacture

Figure 7:
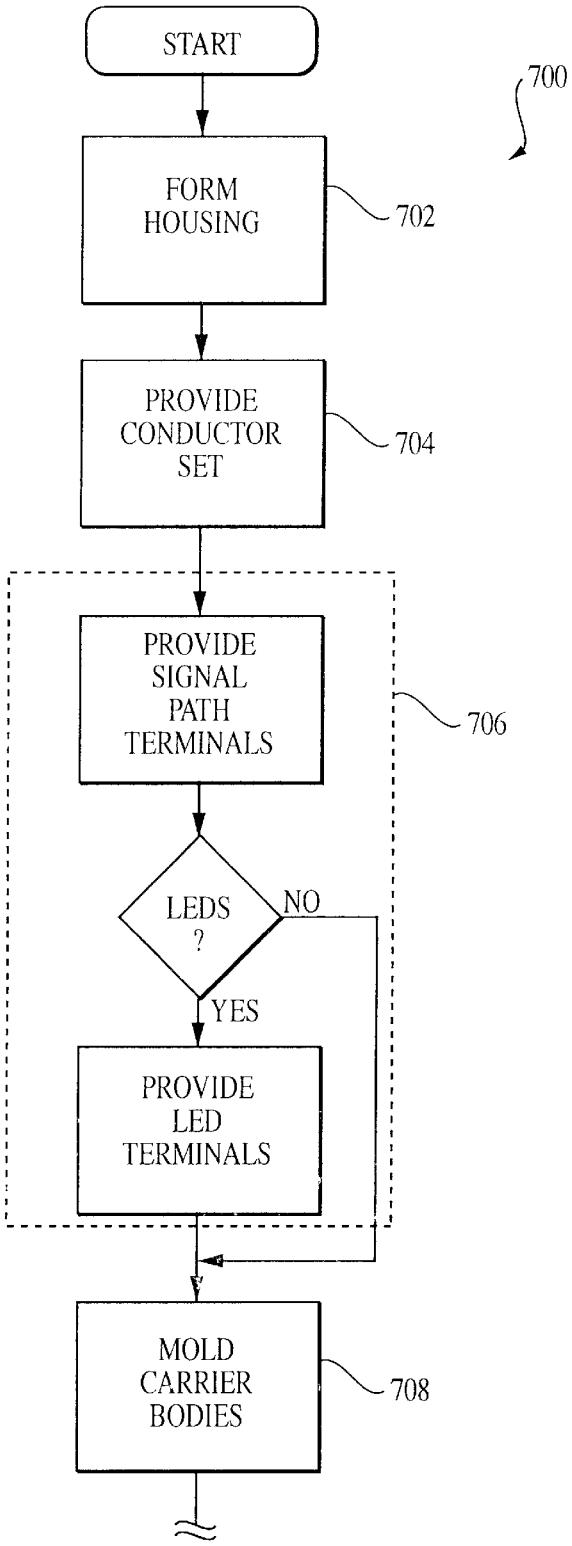
FIG. 7 is a logical flow diagram illustrating one exemplary embodiment of the method of manufacturing the connector assembly of the present invention.
Figure 7:
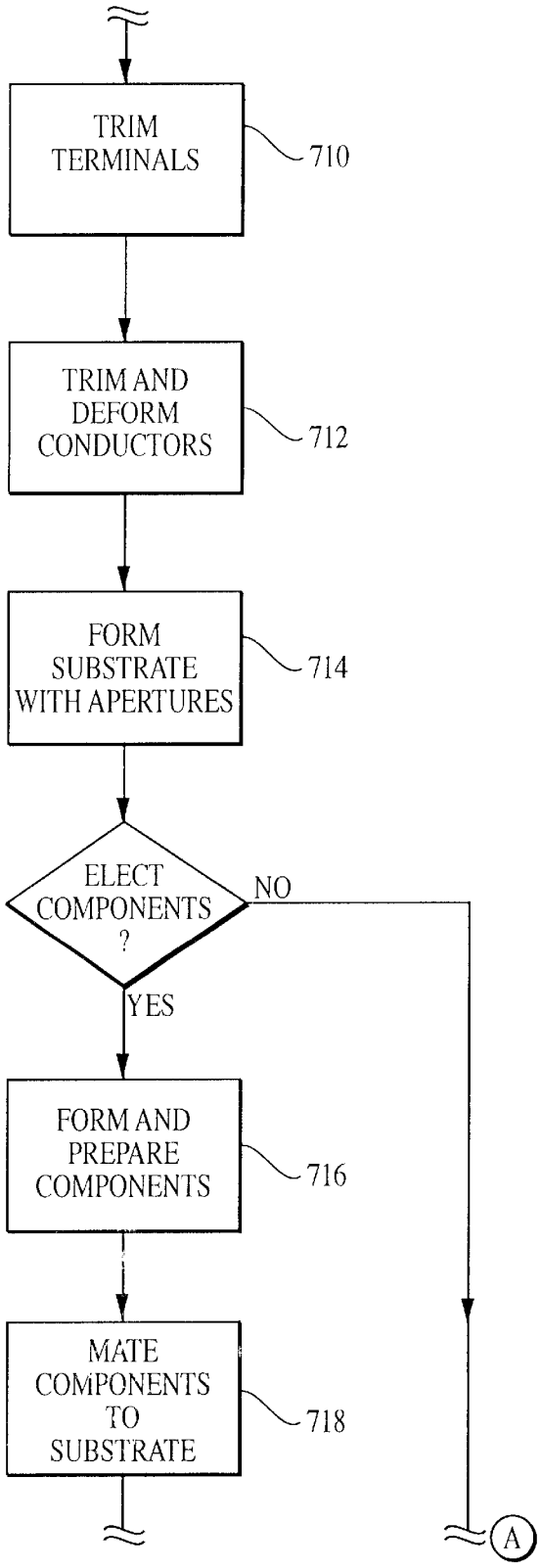
Figure 7:
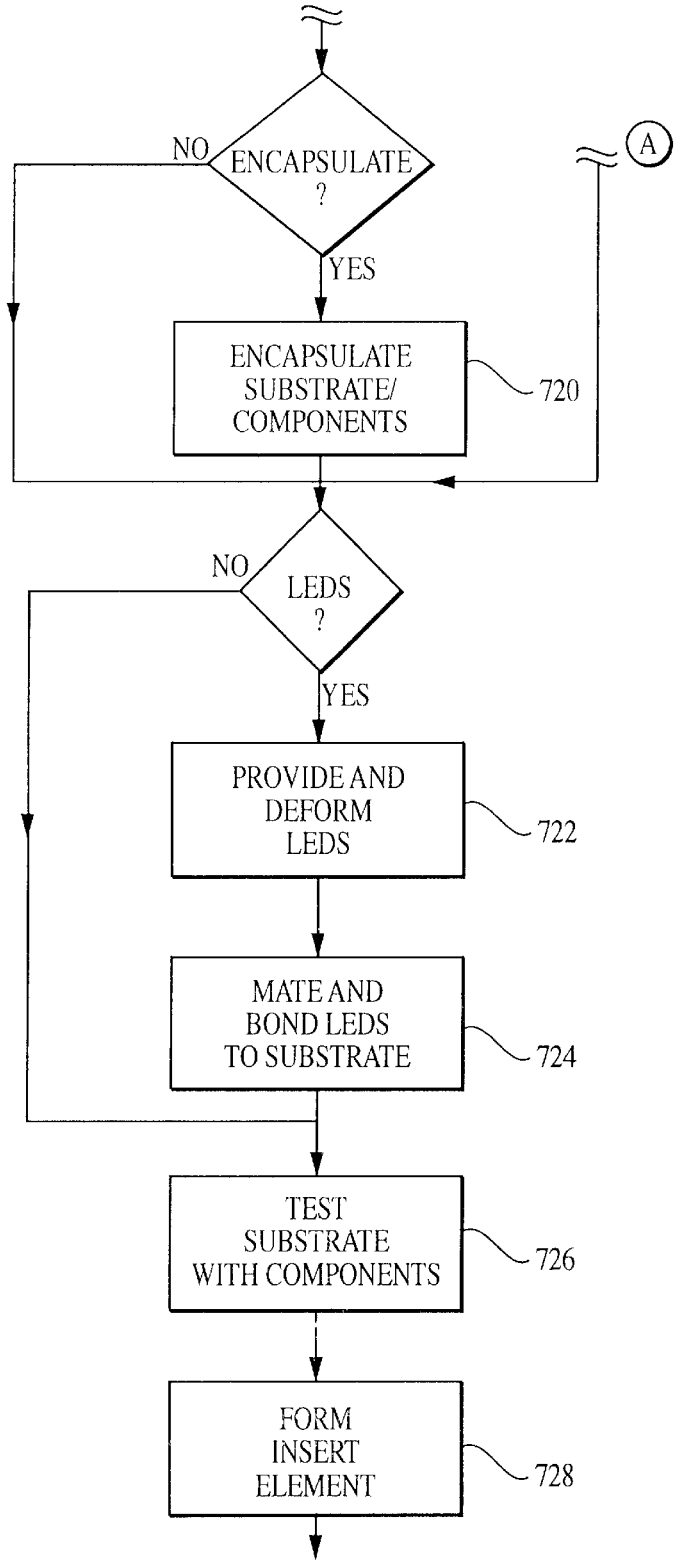
Figure 7:
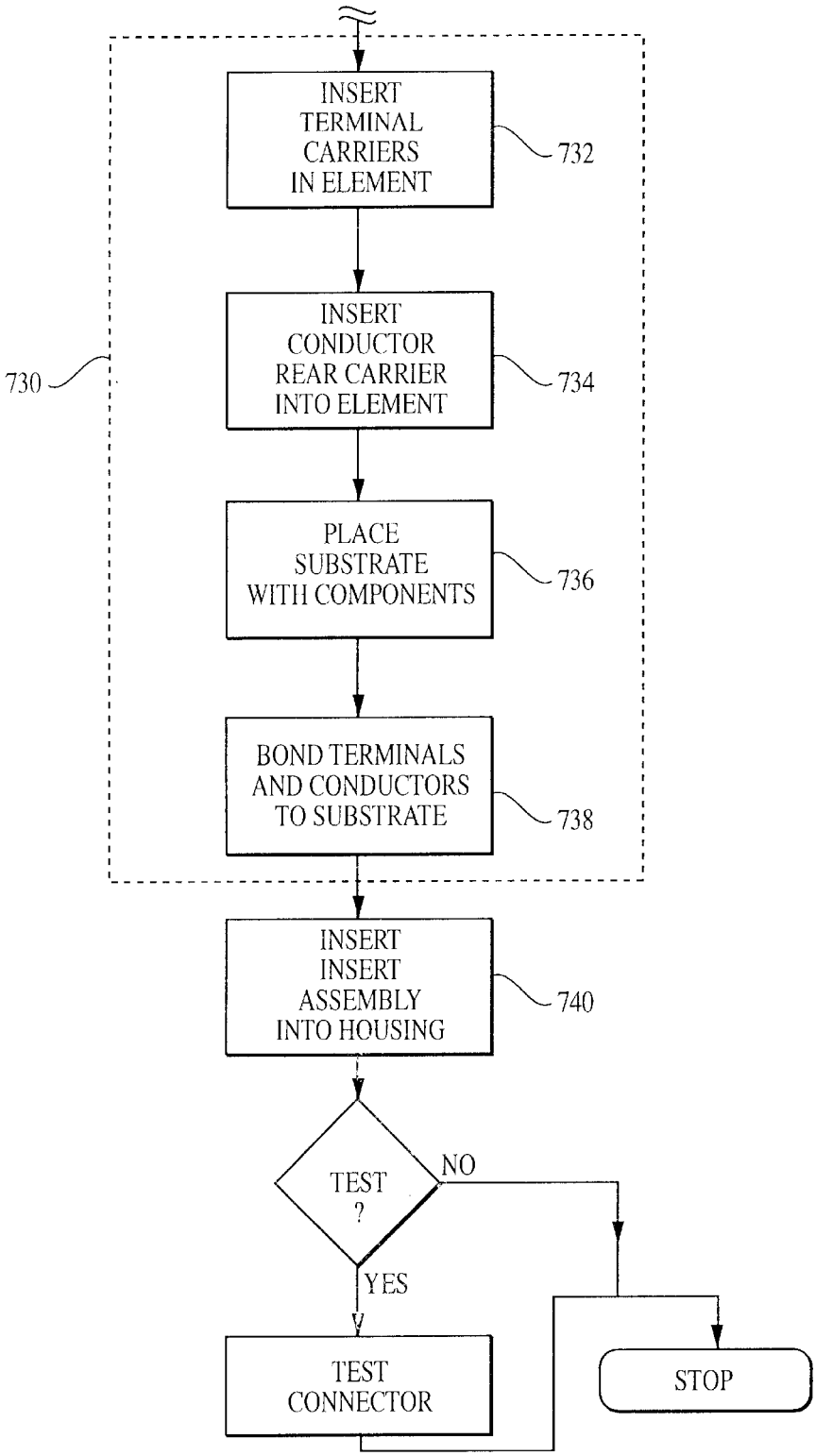

Referring now to FIG. 7, the method 700 of manufacturing the aforementioned connector assembly 100 is described in detail. It is noted that while the following description of the method 700 of FIG. 7 is cast in terms of the single port connector assembly with LEDs, the broader method of the invention is equally applicable to other configurations (e.g., the 1×N embodiment of FIG. 5).

In the embodiment of FIG. 7, the method 700 generally comprises first forming the assembly housing element 102 in step 702. The housing is formed using an injection molding process of the type well known in the art, although other processes may be used. The injection molding process is chosen for its ability to accurately replicate small details of the mold, low cost, and ease of processing. As part of this step, the housing element 102 is also "de-junked" and trimmed as needed.

Next, a conductor set is provided in step 704. As previously described, the conductor set comprises metallic (e.g., copper or aluminum alloy) strips having a substantially square or rectangular cross-section and sized to fit within the grooves 122 of the connectors in the housing 102.

Figure 7A:
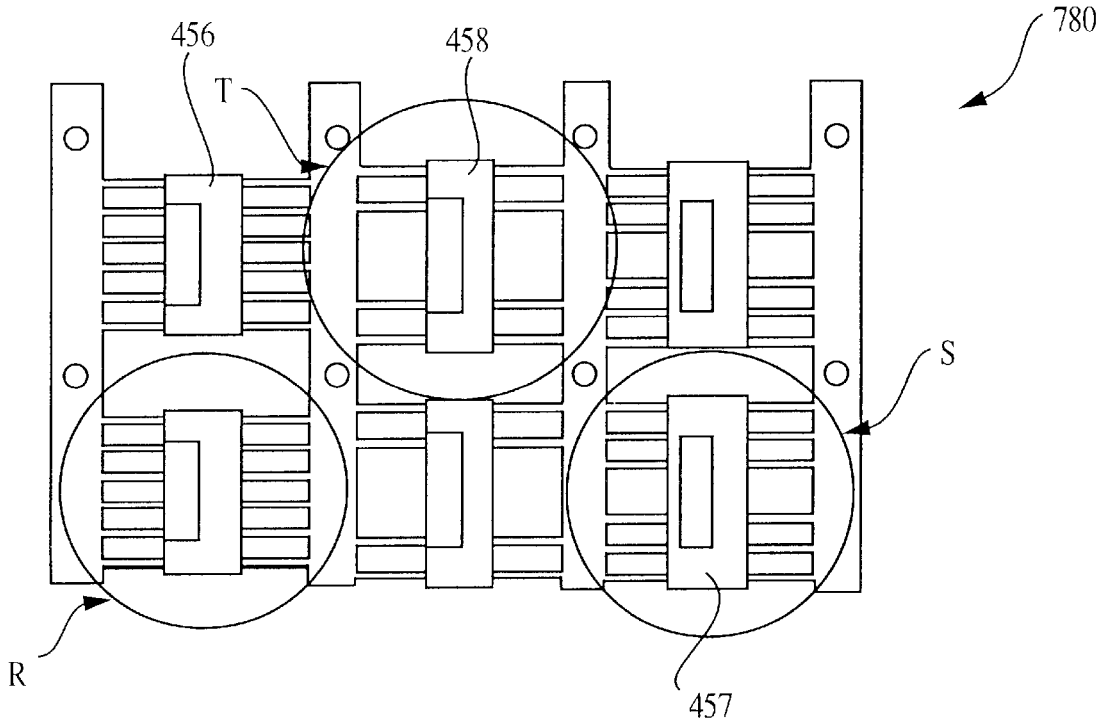
FIG. 7*a* is a top plan view of the lead frame assembly used during manufacture of the terminal carriers (and terminals) of the insert assembly of FIG. 3*a*.

In step 706, sets of terminals 460, 462, 464 (used within the various terminal carriers 450, 452, 454 of the insert assembly) are provided. These terminals are provided in the form of a common lead frame assembly 780 of the type well known in the art, one embodiment of which is shown in FIG. 7*a* herein. The various terminals are arranged such that the molding of the terminal carrier bodies 456 can be performed while the terminals are still attached to the lead frame 782.

In step 708, the various carrier bodies 216, 220, 456, 457, 458 are molded onto the lead frames to form, inter alia, the assembly 780 shown in FIG. 7*a*. The terminals are next trimmed from their respective lead frames to an appropriate length so as to produce the finished terminal carriers 450, 452, 454 (step 710).

Similarly, the conductors 212 with molded carriers 216, 220 are trimmed to produce an unfinished conductor assembly 217 as shown in FIG. 2*e*. The conductors 212 of the unfinished conductor assembly 217 are then deformed as previously described (step 712) to produce the finished assembly shown in FIG. 2*a*.

Note also that either or both of the aforementioned conductor/terminal sets may also be notched (not shown) at the appropriate end such that electrical leads associated with the electronic components (e.g., fine-gauge wire wrapped around a magnetic toroid element) may be wrapped around the distal end notch to provide a secure electrical connection.

Next, the substrate 301 is formed and perforated through its thickness with a number of apertures of predetermined size in step 714. Methods for forming substrates are well known in the electronic arts, and accordingly are not described further herein. Any conductive traces and terminal pads on the substrate required by the particular design are also added, such that necessary ones of the conductors 212, 382 or terminals 460, 462, 464, when received within the apertures, are in electrical communication with the traces. As previously discussed, the apertures within the substrate are arranged in arrays of juxtaposed perforations, and with spacing (i.e., pitch) such that their position corresponds to the desired pattern, although other arrangements may be used. Any number of different methods of perforating the substrate may be used, including a rotating drill bit, punch, heated probe, or even laser energy. Alternatively, the apertures may be formed at the time of formation of the substrate itself, thereby obviating a separate manufacturing step.

In step 716, one or more electronic components, such as the aforementioned toroidal coils and surface mount devices, are next formed and prepared (if used in the design). The manufacture and preparation of such electronic components is well known in the art, and accordingly is not described further herein. The electronic components are then mated to the substrate 301 in step 718. Note that if no components are used, the conductive traces formed on/within the primary substrate will form the conductive pathway between the interface portions 218 of the conductors 212 and respective ones of the terminals 460, 462. The components may optionally be (i) received within corresponding apertures designed to receive portions of the component or its terminals (e.g., for mechanical stability), (ii) bonded to the substrate such as through the use of an adhesive or encapsulant, (iii) mounted in "free space" (i.e., held in place through tension generated on the electrical leads of the component when the latter are terminated to the substrate conductive traces and/or conductor distal ends, or (iv) maintained in position by other means. In one embodiment, the surface mount components are first positioned on the primary substrate, and the magnetics (e.g., toroids) positioned thereafter, although other sequences may be used. The components are electrically coupled to the PCB using a eutectic solder re-flow process as is well known in the art. The assembled primary substrate with electronic components is then optionally secured with a silicon encapsulant (step 720), although other materials may be used.

In step 722, the LEDs 380 (if used) are provided and their conductors 382 deformed in accordance with design specifications so as to allow mating with the substrate 301 and positioning within the apertures 105*a*, 105*b* of the housing element 102 when the connector 100 is assembled. The deformed LED conductors 382 are then mated with the substrate 301 by inserting their conductors into respective apertures formed in the substrate, and bonding the conductors to the pads/traces thereof (step 724).

In step 726, the assembled substrate 301 with surface mount components/magnetics is electrically tested to ensure proper operation. Alternatively, testing can be completed at other subsequent stages of assembly, including after the connector is completely assembled.

Next, the insert element 400 is formed using a molding process such as that used for the housing 102 (step 728). As part of this process, the insert element is de-junked and trimmed as needed.

The insert assembly 300 is next assembled in step 730. Specifically, in step 732, the trimmed, finished terminal carriers 450, 452, 454, are inserted into their respective cavities formed in the insert element 400. Similarly, in step 734, the second carrier 220 of the conductor assembly (and interface portions 218) is inserted into the front portion 410 of the insert element 400 such that the distal ends of the interface portions 218 protrude from the apertures 420*a* formed in the front portion 410, as best shown in FIG. 3*a*.

In step 736, the previously assembled substrate 301 with electronic components is then placed atop the insert element 400 (and terminals) such that the apertures in the substrate 301 receive respective ones of the conductors and signal path/LED terminals therein, and the substrate rests on the upper surfaces 423*a–b* of the element 400. The conductor/terminal ends are optionally bonded thereto (such as by using eutectic solder bonded to the conductor/terminal and surrounding substrate terminal pad, or adhesive) per step 738. Additionally the terminals/conductors may be frictionally received within their respective apertures, the latter being slightly undersized so as to create the aforementioned frictional relationship. As yet another alternative, the distal ends of the conductors/terminals may be tapered such that a progressive frictional fit occurs, the taper adjusted to allow the conductor penetration within the board to the extent (e.g., depth) desired.

The finished insert assembly 300 is then inserted into the cavity 134 of the housing element 102 in step 740, and the contact portions 224 of the conductors 212 received into respective ones of the grooves 122 formed in the assembly housing 102. The LEDs 380 are similarly aligned with and received within their respective apertures 105 within the housing 102, such that they are substantially flush with the front face of the connector 100 when the insert assembly 300 is fully received. As previously noted, the insert assembly 300 may be made to "snap" into place when in proper position within the cavity 134 using, for example, the tabs 333 on the insert element 400.

With respect to the other embodiments described herein (i.e., multi-port 1×N connector housing, connector without LEDs, etc.), the foregoing method may be modified as necessary to accommodate the additional components. For example, where a multi-port connector is used, a single common housing element may be fabricated. Such modifications and alterations will be readily apparent to those of ordinary skill, given the disclosure provided herein.

It will be recognized that while certain aspects of the invention are described in terms of a specific sequence of steps of a method, these descriptions are only illustrative of the broader methods of the invention, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the invention disclosed and claimed herein.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. A connector assembly comprising:

a connector housing comprising a recess adapted to receive at least a portion of a modular plug, said modular plug having a plurality of terminals disposed thereon;

at least one substrate having a plurality of electrically conductive pathways associated therewith said at least one substrate being disposed in a substantially horizontal orientation;

a plurality of first conductors disposed at least partly within said recess, said first conductors being configured to form an electrical contact with respective ones of said terminals when said modular plug is received within said recess, and form at least one electrical pathway between said first conductors and at least one of said plurality of conductive pathways of said substrate;

a plurality of second conductors, at least one of said second conductors being in electrical conmiunication with respective ones of at least a portion of said plurality of electrically conductive pathways of said at least one substrate, and adapted to electrically interface with an external device;

an insert element adapted to receive said at least one substrate and a portion of said plurality of first conductors; and a cavity formed within said housing and adapted to receive at least a portion of said at least one insert element, first conductors, and at least one substrate therein.

2. The connector assembly of claim 1, further comprising at least one electrical component disposed on said substrate and electrically interposed within at least one of said electrically conductive pathways.

3. The connector assembly of claim 2, wherein said at least one electrical component comprises a substantially toroidal magnetic core.

4. The connector assembly of claim 1, wherein at least a portion of said second conductors are received within at least one carrier, said insert element being adapted to receive at least a portion of said at least one carrier therein.

5. The connector assembly of claim 4, wherein one end of said first conductors is received within a first carrier, and first and second portions of said plurality of second conductors are received within second and third carriers, respectively.

6. The connector assembly of claim 1, wherein said at least one substrate further comprises a plurality of apertures formed therein, said apertures being adapted to receive respective ones of said first and second conductors.

7. The connector assembly of claim 1, further comprising:

at least one light source having a plurality of electrical conductors, said light source electrical conductors communicating with respective ones of at least a portion of said electrically conductive pathways of said substrate; and a plurality of third conductors in electrical communication with said at least portion of electrically conductive pathways, thereby forming at least one electrical pathway from said third terminals to said at least one light source.

8. The connector assembly of claim 7, wherein said electrical conductors of said at least one light source are received within respective apertures formed within said at least one substrate.

9. The connector assembly of claim 7, wherein said at least one light source comprises a light-emitting diode (LED).

10. The connector assembly of claim 1, wherein both said connector housing and at least one substrate are longer in depth than length.

11. The connector assembly of claim 1, wherein said insert element is disposed substantially along the bottom interior surface of said housing when inserted into said cavity.

12. The connector assembly of claim 11, wherein at least a portion of said first conductors is disposed along the bottom interior surface of said housing.

13. The connector assembly of claim 5, wherein said insert element is disposed substantially along the bottom interior surface of said housing when inserted into said cavity.

14. The connector assembly of claim 13, wherein at least a portion of said first conductors is disposed along the bottom interior surface of said housing.

15. An insert assembly adapted for use within the housing of a modular connector, comprising:

an insert element having a plurality of cavities formed therein;

a plurality of first conductors adapted for mating with respective ones of a modular plug, at least a portion of said first conductors being received within a first of said cavity;

a plurality of second conductors adapted for electrical interface with an external device, said second conductors being disposed at least partly within a second of said cavities; and a substrate disposed in a substantially horizontal orientation communicating with said insert element and having a plurality of conductive traces associated therewith, said conductive traces forming electrical pathways between at least some respective ones of said first conductors and said second conductors.

16. The insert assembly of claim 15, wherein said insert element and said first conductors form a substantially planar assembly.

17. The insert assembly of claim 15, further comprising first and second carriers disposed at least partly within said first and second cavities, said first carrier being formed around at least a portion of said first conductors, said second carrier being formed around at least a portion of said second conductors.

18. The insert assembly of claim 15, further comprising a plurality of third conductors disposed at least partly within a third of said cavities, said third conductors being adapted to communicate with corresponding conductive traces associated with said substrate.

19. The insert assembly of claim 18, further comprising at least one light source, said at least one light source being in electrical communication with at least a portion of said third conductors via said corresponding conductive traces.

20. The insert assembly of claim 18, further comprising a third carrier disposed at least partly within said third cavity, said third carrier being formed around at least a portion of said third conductors.

21. The insert assembly of claim 15, wherein said substrate sits substantially atop said insert element.

22. The insert assembly of claim 21, wherein said second conductors are substantially straight.

23. A low noise electrical connector adapted to receive at least one modular plug having a plurality of conductive terminals disposed thereon, comprising:

a housing having at least one recess adapted to receive said at least one modular plug and a cavity;

a substrate having a plurality of conductive traces and electronic components associated therewith;

an insert element communicating with said substrate and having first and second portions, said insert element and said substrate being adapted to be at least partly received within said cavity;

a plurality of first conductors adapted to mate with respective ones of said terminals of said modular plug and with respective ones of said traces, said plurality of first conductors being at least partly received within said first portion of said insert element, the majority of length of said first conductors being disposed away from said electronic components, thereby minimizing the electromagnetic interaction between said electronic components and said first conductors; and a plurality of second conductors adapted to electrically interface with an external device and with respective ones of said traces, said second conductors being at least partly received within said second portion of said insert element.

24. The connector of claim 23, wherein said first and second conductors are removable, respectively, from said first and second portions of said insert element.

25. The connector of claim 23, wherein said first conductors and said insert element for a substantially coplanar assembly.

26. The connector of claim 25, wherein said substrate is disposed in a substantially parallel orientation with respect to said coplanar assembly formed by said first conductors and said insert element.

27. The connector of claim 25, wherein said substantially coplanar assembly is disposed substantially along the bottom surface of said cavity.

28. The connector of claim 23, wherein said first and second portions further comprise first and second cavities, respectively, said first and second cavities being adapted to receive respective first and second carriers disposed at least partly around said first and second conductors.

29. The connector of claim 28, further comprising a third carrier disposed at least partly around said first conductors at a location different than said first carrier.

30. A method of manufacturing, comprising:

forming an insert element having a plurality of recesses and adapted to be received within a housing;

forming a plurality of first conductors;

providing a plurality of second conductors;

forming first and second carriers around at least a portion of said first and second conductors;

providing a substrate;

forming a plurality of conductive traces upon said substrate;

inserting a portion of said first and second carriers including said conductors within respective ones of said recesses;

positioning said substrate in a substantially parallel orientation with said insert element;

inserting the distal ends of said first and second conductors within apertures formed in said substrate such that said first and second conductors are in electrical communication via said conductive traces.

31. The method of claim 30, further comprising:

forming a housing having a cavity;

inserting said insert element, conductors, and substrate at least partly within said cavity; and removably securing said insert element within said housing.

32. An electrical assembly, comprising:

a housing having at least one recess adapted to receive said at least one modular plug and a cavity;

an external substrate having a plurality of conductive traces;

an internal substrate having a plurality of conductive traces associated therewith and disposed in an orientation which is substantially parallel with said external substrate;

an insert element communicating with said internal substrate and having first and second portions, said insert element and said internal substrate being adapted to be at least partly received within said cavity;

a plurality of first conductors adapted to mate with respective ones of said terminals of said modular plug and with respective ones of said traces of said internal substrate, said plurality of first conductors being at least partly received within said first portion of said insert element; and a plurality of second conductors adapted to electrically interface with respective ones of said traces of said internal substrate and of said external substrate, said second conductors being at least partly received within said second portion of said insert element.

33. The assembly of claim 32, further comprising an external. noise shield disposed around at least a portion of said housing and electrically grounded to said external substrate.

34. An electrical connector assembly adapted to receive a plurality of modular plugs each having a plurality of conductive terminals disposed thereon, comprising:

a housing having:

a plurality of recesses adapted to receive respective ones of said plurality of modular plugs; and a plurality of cavities;

a plurality of substrates each having a plurality of conductive traces associated therewith, and sized so as to be at least partly received within respective ones of said cavities;

a plurality of insert elements communicating with respective ones of said substrates in multiple locations and each having first and second portions, said insert elements being adapted to be at least partly received within respective ones of said cavities;

a plurality of sets of first conductors adapted to mate with respective ones of said terminals of said modular plugs and with respective ones of said traces, said plurality of first conductors of each of said sets being at least partly received within said first portions of respective ones of said insert elements; and a plurality of sets of second conductors adapted to electrically interface with an external device and with respective ones of said traces, said sets of second conductors each being at least partly received within said second portions of respective ones of said insert elements.

35. The assembly of claim 34, further comprising an external noise shield disposed around at least a portion of said housing and electrically grounded to said external device.

36. The assembly of claim 34, further comprising:

a plurality of sets of third conductors in electrical communication with said external device; and a plurality of sets of light sources disposed at least partly within said housing and electrically communicating with conductive traces on respective ones of said substrates, respective ones of said third conductors being in electrical communication with said traces so as to form electrical pathways between said external device and said light sources.

37. A low-noise insert element adapted for use in a modular connector having a housing, a plurality of first conductors, and a plurality of second conductors, comprising:

a substantially planar insert body adapted to be received within the housing of said modular connector in a horizontal disposition and having:

(i) a front portion having a first cavity formed therein, and a plurality of first apertures formed within said front portion and communicating with said first cavity, said first apertures being adapted to receive respective ones of said first conductors;

(ii) a rear portion having at least a second cavity formed therein, and a plurality of second apertures formed in said rear portion and communicating with said at least second cavity, said second apertures being adapted to receive respective ones of said second conductors; and (iii) first and second surfaces adapted to communicate with different portions of an internal substrate, said substrate being disposed substantially parallel to the plane of said insert body, said surfaces being disposed proximate to said first and second apertures, respectively, thereby allowing connection of conductive traces of said substrate with said first and second conductors.

38. An insert element adapted for use in a modular connector having a housing, a plurality of first conductors, and a plurality of second conductors, comprising:

an insert body adapted to be received within the housing of said modular connector and having:

(i) a first portion having a first cavity formed therein, said first cavity being adapted to receive a first carrier formed around at least a portion of said first conductors;

(ii) a second portion having at least a second cavity formed therein, said at least second cavity being adapted to receive at least a second carrier formed around at least a portion of said second conductors; and (iii) at least one surface adapted to communicate with an internal substrate, said at least one surface being disposed proximate to said first and second cavities, thereby allowing connection of conductive traces of said substrate with said first and second conductors.

* * * * *